US005490943A

United States Patent [19]

Eicken et al.

[11] Patent Number: 5,490,943

[45] Date of Patent: Feb. 13, 1996

[54] SPINNING PREPARATIONS IN THE FORM OF AQUEOUS EMULSIONS OR AQUEOUS SOLUTIONS CONTAINING POLYMERS

[75] Inventors: Ulrich Eicken; Raymond Mathis, both of Duesseldorf; Heidi Fiedler, Korschenbroich; Manfred Gorzinski, Duesseldorf, all of Germany

[73] Assignee: Henkel Kommanditgesellschaft auf Aktien, Duesseldorf, Germany

[21] Appl. No.: 310,017

[22] Filed: Sep. 21, 1994

Related U.S. Application Data

[62] Division of Ser. No. 867,704, Jul. 8, 1992.

[30] Foreign Application Priority Data

Jan. 8, 1990 [DE] Germany ..... 40 00 304.3

[51] Int. Cl.[6] ..... C11D 3/37; C11D 15/00

[52] U.S. Cl. ..... 252/8.6; 252/8.9; 252/174.21; 252/174.23

[58] Field of Search ..... 252/8.6, 8.9, 174.21, 252/174.23

[56] References Cited

U.S. PATENT DOCUMENTS

| | | | |
|---|---|---|---|
| 3,944,663 | 3/1976 | Weiss et al. | 424/78 |
| 4,077,890 | 3/1978 | Barker | 252/8.8 |
| 4,108,800 | 8/1978 | Froehlich | 252/541 |
| 4,253,951 | 3/1981 | McCune | 210/749 |
| 4,310,434 | 1/1982 | Choy et al. | 252/174.21 |

FOREIGN PATENT DOCUMENTS 128882 4/1980 Japan .

*Primary Examiner*—Paul Lieberman
*Assistant Examiner*—Michael P. Tierney
*Attorney, Agent, or Firm*—Wayne C. Jaeschke; John Daniel Wood; Daniel S. Ortiz

[57] ABSTRACT

The invention relates to spinning finishes in the form of aqueous emulsions or aqueous solutions containing water-soluble polymer compounds having weight average molecular weights of more than $10^6$.

7 Claims, No Drawings

SPINNING PREPARATIONS IN THE FORM OF AQUEOUS EMULSIONS OR AQUEOUS SOLUTIONS CONTAINING POLYMERS

CROSS-REFERENCE TO RELATED APPLICATIONS

This application is a divisional application of U.S. Ser. No. 07/867,704, filed Jul. 8, 1992.

FIELD OF THE INVENTION

This invention relates to spinning finishes in the form of aqueous emulsions or aqueous solutions containing water-soluble polymer compounds having weight average molecular weights of more than $10^6$, to a process for reducing the spraying of spinning finishes from fiber surfaces and to the use of certain water-soluble polymer compounds having weight average molecular weights of more than $10^6$ in aqueous emulsion or aqueous solutions of spinning finishes for reducing the spraying of spinning finishes from fiber surfaces.

DISCUSSION OF RELATED ART

In the manufacture of man-made fibers spun from the melt, the first processing step immediately after the capillaries emerge from the spinning jet, i.e. immediately after formation of the filaments, is the treatment of the fiber surface with spinning finishes containing smoothing agents and antistatic agents as their principal active substances (*Chemiefasern/Textil-Industrie* 1977,328–335). It is generally known that man-made fibers can neither be produced nor used in textile further processing without such finishes. A smoothing agent has to be applied because the original surface of most polymeric fibers gives rise to considerable friction forces so that chafing of the fibers occurs through the constant contacts, for example with guide elements, during the production and processing cycles and can ultimately result in filament or yarn breakages. In addition, polymeric filament materials generally absorb only a little water so that they tend to develop electro-static charges.

High-speed machines with filament speeds of up to 6,000 m/minute are now commonly used in the production and further processing of fibers. At these high speeds, a considerable percentage of the textile lubricants applied, such as spinning finishes or winding oils, is often sprayed off. Not only is this spraying of the lubricants a waste, it is also virtually impossible as a result of spraying to keep to the exact quantities to be applied for the individual processes. In addition, spraying also results in a reduction in safety, for example slippery floors in the immediate vicinity of the machines and also breathing difficulties and skin irritation produced by sprayed droplets which are dispersed in the form of fine mists. To reduce the spraying of textile lubricants during the production and further processing of fibers, it has already been repeatedly proposed to add polymer compounds to the textile lubricants. For example, it is known from U.S. Pat. No. 4,400,281 that textile lubricants based on hydrocarbons, such as mineral oils, and/or fatty acid esters and/or fats and/or oils containing high molecular weight polymers of $C_{4-20}$ α-monoolefins show improved adhesion to the fiber surface. In addition, it is known from European patents EP 261 415 and EP 127 293 that the use of high molecular weight polyisobutenes and the use of copolymers containing butenes in combination with $C_{5-20}$ α-olefins as monomer constituents reduce the spray of winding oils during the processing of yarns. The winding oils described in U.S. Pat. No. 4,098,702 contain polymers to improve the viscosity index, for example polyisobutenes having molecular weights in the range from 20,000 to 2,000,000, polyalkyl styrenes having molecular weights in the range from 20,000 to 2,000,000 or polymethacrylates having molecular weights in the range from 300,000 to 800,000, and hence to improve the adhesion of the winding oils to the fiber surface.

SUMMARY OF THE INVENTION

In many cases, however, the reduction in the spraying of textile lubricants, particularly spinning finishes, from fiber surfaces achieved with known polymer compounds is still unsatisfactory. Accordingly, the problem addressed by the present invention was to develop spinning finishes which, compared with known spinning finishes would show distinctly improved adhesion to the fiber surfaces and which would only be sprayed off in very small quantities, if at all, at the high filament speeds typically applied today.

It has now been found that the stringent demands imposed on the spinning finishes to be developed are satisfied if spinning finishes in the form of aqueous emulsions or aqueous solutions contain water-soluble polymer compounds having weight average molecular weights of more than $10^6$.

Accordingly, the present invention relates to spinning finishes based on smoothing agents, emulsifiers, antistatic agents and/or wetting agents containing polymer compounds in the form of aqueous emulsions or aqueous solutions, characterized in that they contain one or more of the following water-soluble polymer compounds having weight average molecular weights of more than $10^6$: polyalkylene oxides and/or polyacrylamides and/or polymethacrylamides and/or copolymers of acrylamide and/or methacrylamide and unsaturated carboxylic acids containing 3 to 5 carbon atoms.

The present invention also relates to a process for reducing the spraying of spinning finishes from fiber surfaces, characterized in that, immediately after the capillaries emerge from the spinning jet, spinning finishes containing one or more of the following water-soluble polymer compounds having weight average molecular weights of more than $10^6$: polyalkylene oxides and/or polyacrylamides and/or polymethacrylamides and/or copolymers of acrylamide and/or methacrylamide and unsaturated carboxylic acids containing 3 to 5 carbon atoms, in the form of aqueous emulsions or aqueous solutions are applied to the filament bundles.

The present invention also relates to the use of water-soluble polyalkylene oxides having weight average molecular weights of more than $10^6$, water-soluble polyacrylamides and/or polymethacrylamides having weight average molecular weights of more than $10^6$ and/or water-soluble copolymers of acrylamide and/or methacrylamide an unsaturated carboxylic acids containing 3 to 5 carbon atoms having weight average molecular weights of more than $10^6$ in aqueous emulsions or aqueous solutions of spinning finishes to reduce the spraying of the spinning finishes from fiber surfaces.

DETAILED DESCRIPTION OF THE INVENTION

The content of water-soluble polymer compounds having weight average molecular weights of more than $10^6$ in the aqueous emulsions or in the aqueous solutions of the spinning finishes according to the invention is preferably between 0.0001 and 0.3% by weight and more preferably between 0.005 and 0.05% by weight. Polyethylene oxides, polyacrylamides and/or copolymers of acrylamide carboxylic acids containing 3 to 5 carbon atoms are preferably used as the water-soluble polymer compounds having weigh average molecular weights of more than $10^6$. Polyethylene oxides having weight average molecular weights of more than $10^6$ are marketed, for example, by Union Carbide as powders under the names of Polyox® WSR301 and Polyox® WSR Coagulant while polyacrylamides having weight average molecular weights of more than $10^6$ are marketed, for example, by Henkel KGaA under the name of Ferrocryl® or by Stockhausn under the name of Praestol®. Copolymers of acrylamide and unsaturated carboxylic acids containing 3 to 5 carbon atoms, for example copolymers of acrylamide and acrylic acid, having weight average molecular weights of more than $10^6$ are obtainable, for example, under the name of Superfloc® (manufacturer: Cyanamid).

In a particularly preferred embodiment, polyethylene oxides are used in spinning finishes as the water soluble polymer compounds having weight average molecular weights of more than $10^6$.

Either water-soluble polymer compounds having weight average molecular weights of more than $10^6$ are added to aqueous emulsions or aqueous solutions of spinning finishes containing smoothing agents, emulsifiers, antistatic agents and/or wetting agents and, optionally, other additives or corresponding aqueous emulsions or aqueous solutions of spinning preparations are added to water-soluble polymer compounds having weight average molecular weights of more than $10^6$. In the production of the spinning finishes according to the invention, the water-soluble polymer compounds are preferably used in the form of aqueous solutions. The aqueous polymer-containing spinning finish emulsions or solutions obtained preferably contain 0.0001 to 0.3% by weight and, more preferably, 0.005 to 0.05% by weight of water-soluble polymers having weight average molecular weights of more than $10^6$ and have a total active substance content of 3 to 40% by weight. Based on the total active substance content, polymer-free aqueous emulsions or solutions of spinning finishes preferably contain 35 to 95% by weight of smoothing agents, 0 to 55% by weight of emulsifiers, antistatic agents and/or wetting agents, 0 to 10% by weight of additives, for example pH regulators, filament compacting agents, bactericides and/or corrosion inhibitors.

Suitable smoothing agents in spinning finishes according to the invention are,for example, mineral oils, carboxylic acid esters prepared from aliphatic $C_{8-22}$ carboxylic acids and linear and/or branched, optionally alkoxylated $C_{1-22}$ alkyl alcohols, for example isobutyl stearate, n-hexyl laurate, tallow fatty acid 2-ethylhexyl ester, coconut oil fatty acid triglycerides and/or trimethylol propane tripelargonate; silicones, for example dimethyl polysiloxane; and/or polyalkylene glycols, for example ethylene oxidepropylene oxide copolymers having average molecular weights of 600 to 6,000. Suitable emulsifiers, wetting agents and/or antistatic agents are anionic, cationic and/or nonionic surfactants, such as mono- and/or diglycerides, for example glycerol monooleate and/or glycerol dioleate; alkoxylated, preferably ethoxylated and/or propoxylated, fats, oils, $C_{8-22}$ fatty alcohols and/or $C_{8-18}$ alkylphenols, for example castor oil, ethoxylated with 10 to 40 moles ethylene oxide (EO), and/or $C_{16-18}$ fatty alcohols alkoxylated with ethylene oxide and/or propylene oxide; optionally alkoxylated $C_{8-22}$ fatty acid mono- and/or di-ethanolamides, for example optionally ethoxylated oleic acid mono- and/or diethanolamide, tallow fatty acid mono- and/or diethanolamide and/or coconut oil fatty acid mono- and/or diethanolamide; alkali metal and/or ammonium sulfonates of optionally alkoxylated $C_{8-22}$ alkyl alcohols, $C_{8-22}$ alkenyl alcohols and/or aromatic alcohols; reaction products of optionally alkoxylated $C_{4-22}$ alkyl alcohols with phosphorus pentoxide or phosphorus oxychloride in the form of their alkali metal, ammonium and/or amine salts, for example phosphoric acid esters of optionally ethoxylated $C_{12/14}$ fatty alcohols; alkali metal and/or ammonium salts of $C_{8-22}$ alkyl sulfosuccinates, for example sodium dioctyl sulfosuccinate; and/or amine oxides, for example dimethyl dodecylamine oxide. It is important to bear in mind in connection with this exemplary list of smoothing agents, emulsifiers, antistatic agents and/or wetting agents that many of the substances mentioned perform not just one function, but several functions in spinning finishes. For example, a smoothing agent may also act simultaneously as an anti-static agent and/or as an emulsifier.

Emulsifiers, antistatic agents and/or wetting agents may be mixed in any ratio with one another for use in the spinning finishes according to the invention.

The spinning finishes according to the invention may contain as additives pH regulators, for example aliphatic $C_{1-22}$ carboxylic acids and/or $C_{1-4}$ hydroxycarboxylic acids, such as acetic acid, glycolic acid and/or oleic acid, alkali metal hydroxides, such as potassium hydroxide, and/or amines, such as triethanolamine; filament compacting agents, for example fatty acid sarcosides and/or copolymers with maleic anhydride and/or polyurethanes according to DE 38 30 468; bactericides and/or corrosion inhibitors.

Polymer-containing spinning finishes in the form of aqueous emulsions or solutions are applied in known manner immediately after the capillaries leave the spinning jet. The finishes, which have a temperature of 18° to 30° C., are applied by applicator rollers or by metering pumps via suitable applicators. The quantity of active substance (oil) applied with the spinning finish emulsions or solutions according to the invention is between 0.3 and 2.0% by weight, based on the weight of the filament bundles. After the treatment with the finishes, the filament bundles are wound onto spools. The filament bundles may consist, for example, of polyesters, polyamides, polyolefins, and/or polyacrylics.

The spinning finishes according to the invention adhere very firmly to fiber surfaces and are sprayed off in only very small quantities at the high filament speeds typically applied today.

EXAMPLES

Percentages are by weight.

Composition of the spinning finish 78.5% isobutyl stearate

5% oleyl/cetyl alcohol×5 moles EO 2.2% coconut oil fatty acid monoethanolamide×4 moles EO, 0.8% oleic acid 6% Tergitol® 15S3 (secondary fatty alcohol×3 moles EO, a product of Union Carbide)

6% Tergitol® 15S7 (secondary fatty alcohol×7 moles EO, a product of Union Carbide)

1.5% water

An aqueous emulsion was prepared from 150 g of the above-mentioned spinning finish and 840 g water and 10 g of an aqueous 1% by weight Polyox® WSR301 solution were stirred into the emulsion thus prepared at 20° C. Polyester (167 dtex/34 filaments) was spun at a speed of 3,200 meters per minute. The polymer-containing spinning finish emulsion which had a temperature of 20° C. was applied via a metering pump (amount of oil applied: 1.5%) immediately after the capillaries had left the spinning jet. At the first place after application of the spinning preparation at which the fiber bundle changed its direction of travel, the quantity sprayed off was collected and weighed. By comparison with the spinning finish with no added polymer, a reduction in the quantity sprayed off of 82% was achieved with the polymer-containing spinning finish.

We claim:

1. An aqueous spinning finish comprising a solution or emulsion containing from 3% to 40% by weight of a composition containing:

(a) 35% to 95% by weight of at least one smoothing agent selected from the group consisting of mineral oil, esters of $C_{8-22}$ carboxylic acids with $C_{1-22}$ alkyl alcohols, silicones, polyoxyalkylene glycol having an average molecular weight of 600 to 6,000;

(b) 0–55% by weight of at least one member selected from the group consisting of emulsifiers, antistatic agents and wetting agents;

(c) 0–10% by weight of at least one additive selected from the group consisting of pH regulators, filament compacting agents, bactericides and corrosion inhibitors; and from 0.0001% to 0.3% by weight of the solution or emulsion of at least one water-soluble polymer compound having a weight average molecular weight of more than $10^6$ selected from the group consisting of polyalkylene oxides, polyacrylamides, polymethacrylamides and copolymers of acrylamide or methacrylamide with unsaturated carboxylic acid containing 3 to 5 carbon atoms.

2. The spinning finish as claimed in claim 1, comprising from 0.005 to 0.05% by weight of the water-soluble polymer compound.

3. The spinning finish as claimed in claim 2, wherein said water soluble polymer compounds are selected from the group consisting of polyethylene oxide, polyacrylamides, and copolymers of acrylamide and unsaturated carboxylic acids containing 3 to 5 carbon atoms.

4. The spinning finish as claimed in claim 3, wherein said water-soluble polymer compound is polyethylene oxides.

5. The spinning finish as claimed in claim 3, wherein said water-soluble polymer compound is polyethylene oxide.

6. The spinning finish as claimed in claim 1, wherein said water soluble polymer compounds are selected from the group consisting of polyethylene oxide, polyacrylamides, and copolymers of acrylamide and unsaturated carboxylic acids containing 3 to 5 carbon atoms.

7. The spinning finish as claimed in claim 6, wherein said water-soluble polymercompounds are polyethylene oxides.

* * * * *

UNITED STATES PATENT AND TRADEMARK OFFICE

CERTIFICATE OF CORRECTION

PATENT NO. : 5,490,943

DATED : Feb. 13, 1996

INVENTOR(S) : Eicken et al.

It is certified that error appears in the above-indentified patent and that said Letters Patent is hereby corrected as shown below:

In Col 2, line 56, "an" should read --and--.

In Col 5, claim 1, line 19, please delete [containing] and insert --consisting essentially of--.

In Col 5, claim 1(a), line 23, please delete [polyoxyalkylene glycol] and insert --ethylene oxide and propylene oxide copolymers--.

In Col 6, claim 1(c), lines 1 and 2, please delete [and from 0.0001% to 0.3% by weight of the solution or emulsion of] and insert --;--.

In Col 6, claim 1(c), line 4, after "of" please insert --from 0.0001 to 0.05% by weight of the spinning finish of--.

In Col 6, claim 1(c), line 5, after "oxides" please insert --and from 0.0001 to 0.3% by weight of the spinning finish of--.

In Col 6, claim 4, line 19, "oxides" should read --oxide--.

Signed and Sealed this

Thirty-first Day of March, 1998

Bruce Lehman

*Attest:*

BRUCE LEHMAN

*Attesting Officer*

*Commissioner of Patents and Trademarks*